US005612932A

United States Patent [19]

Albenda

[11] Patent Number: 5,612,932

[45] **Date of Patent: *Mar. 18, 1997**

[54] WATCH AND TIMEPIECE ATTACHING DEVICE

[76] Inventor: Abraham R. Albenda, 276 Exetes St., Brooklyn, N.Y. 11235

[ * ] Notice: The portion of the term of this patent subsequent to Jun. 2, 2012, has been disclaimed.

[21] Appl. No.: 70,732

[22] Filed: Jun. 2, 1993

[51] Int. Cl.[6] ..... G04B 37/00

[52] U.S. Cl. ..... 368/276; 368/317

[58] Field of Search ..... 368/10, 276, 278, 368/316–317; 224/903; 248/114–116

[56] References Cited

U.S. PATENT DOCUMENTS 1,315,326 9/1919 Palis .
3,312,435 4/1967 Malone .
3,719,037 3/1973 Williams .
4,331,721 5/1982 Ayers ..... 428/23
4,794,578 12/1988 Leo ..... 368/116
5,327,115 7/1994 Swierczek ..... 340/309.15

*Primary Examiner*—Vit W. Miska
*Attorney, Agent, or Firm*—Frishauf, Holtz, Goodman, Langer & Chick

[57] ABSTRACT

A simple, inexpensive reliable an unobtrusive method of attaching a watch or other timepiece to anything with an edge without damaging the item the watch is attached to. The device is merely twisted onto the edged item (i.e. cap, sleeve, pocket, book, etc.) and placed at the proper angle. The attaching device is a spiral type of apparatus that is attached or molded into the back of the watch. The device is springy enough to open, yet rigid enough to hold the timepiece in place when twisted onto the intended item.

5 Claims, 4 Drawing Sheets

WATCH AND TIMEPIECE ATTACHING DEVICE

BACKGROUND OF INVENTION

The objective of this invention is to provide a unique, simple, inexpensive, reliable and unobtrusive method of attaching a timepiece to anything that has an edge or lip. This method of attachment will allow the user to place the timepiece on anything with an edge and not make a hole or damage the edged item (i.e. tie, sleeve, cap) in any way.

Another objective is to allow a child to attach the timepiece without the assistance of an adult.

A third objective is to eliminate the need for a watchband.

A fourth objective of the invention is to allow the user to have the timepiece at any angle allowing for the time to be read at a variety of locations.

SUMMARY OF THE INVENTION

According to the present invention, a simple, spiral device with a spring will be connected to or molded into a timepiece allowing for the timepiece to be attached to anything with an edge, lip or tongue-like protrusion with a simple twisting motion. The spiral member will be connected to a hat brim, sleeve, tie, book or any other item with an edge by sliding the end of the spiral over or under the edge and twisting the attaching spiral member and timepiece to the desired angle so that the timepiece could be easily read.

The spiral portion of the said attaching member would be at least one complete revolution, or 360 degrees, allowing for the placement of the timepiece at any desired angle. The device will be made of a material with memory or resiliency, such as plastic or metal, which allows the spiral to recoil and hold firmly onto the edged item.

DETAILED DESCRIPTION

Figure 1:
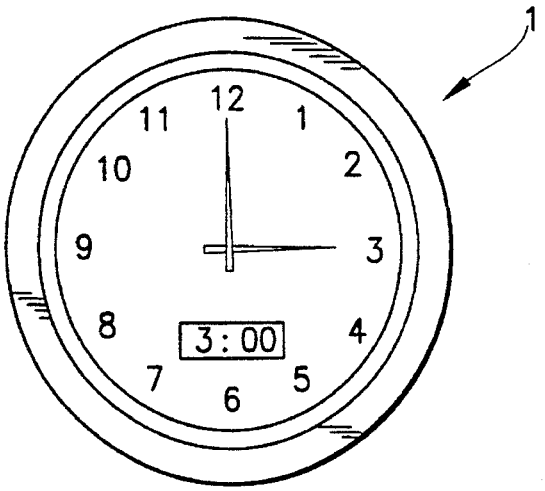
FIG. 1 is a top view of the timepiece and attachment showing face of watch completely concealing attachment.

FIG. 1 shows the face of a timepiece 1 with the total attachment hidden.

Figure 2:
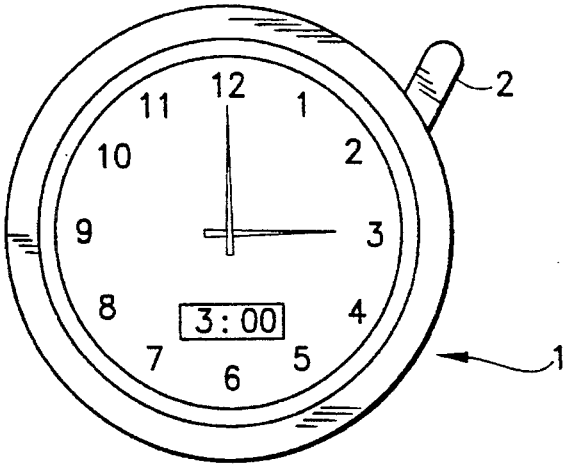
FIG. 2 is a top view of timepiece and attachment showing end of attaching device.

FIG. 2 shows the face of the timepiece 1 with the lead piece 2 of the attaching device protruding from behind the timepiece 1.

Figure 3:
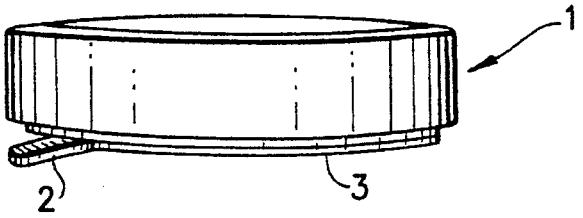
FIG. 3 is a side view of timepiece and attachment.

FIG. 3 shows a side view of the timepiece 1 with the lead portion 2 of the attaching device facing downward with the flexible spiral 3 coiled and in close contact with the timepiece 1.

Figure 4:
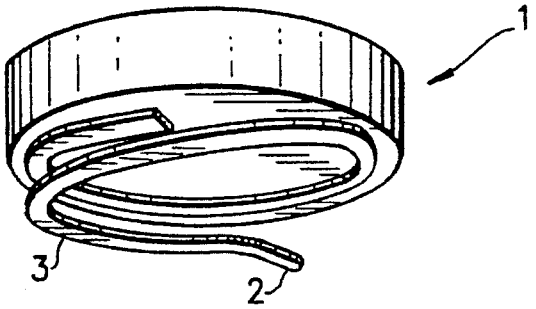
FIG. 4 is a side view of timepiece with attachment stretched out.

FIG. 4 shows a side view of the timepiece 1 with the flexible spiral 3 stretched out and in position to be attached to any edged item.

Figure 5:
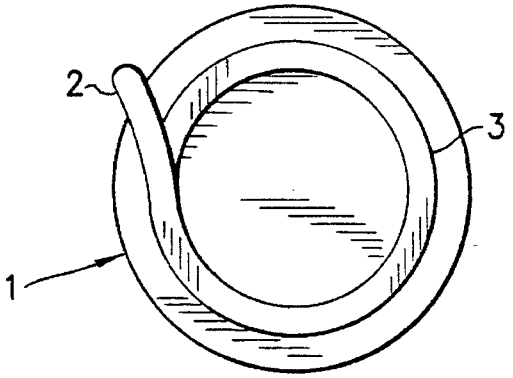
FIG. 5 is a bottom view showing timepiece and attachment.

FIG. 5 shows a bottom view of timepiece 1 with the lead portion 2 of the attaching device with the flexible portion 3 in circular spiral.

Figure 6:
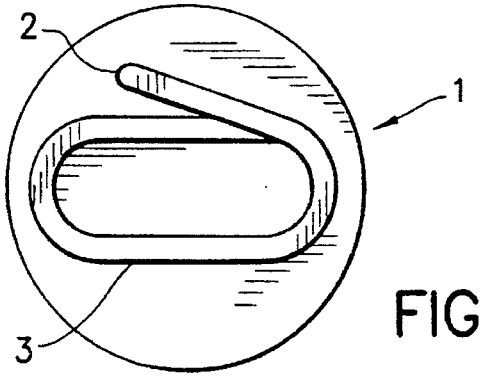
FIG. 6–8 are bottom views showing alternative shapes of attachment.

FIG. 6 shows a bottom view of timepiece 1 with the lead portion 2 of the attaching device with the flexible portion 3 in the form of an ellipse.

Figure 7:
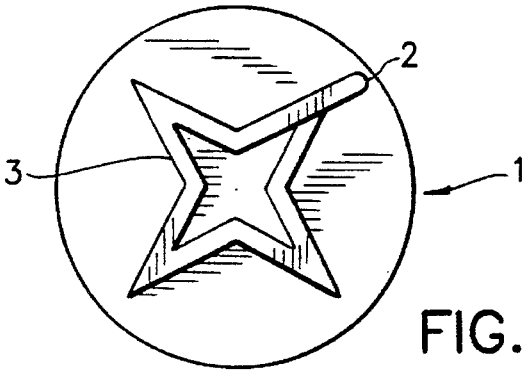

FIG. 7 shows a bottom view of the timepiece 1 with the flexible portion 3 of the device in an irregular angular form.

Figure 8:
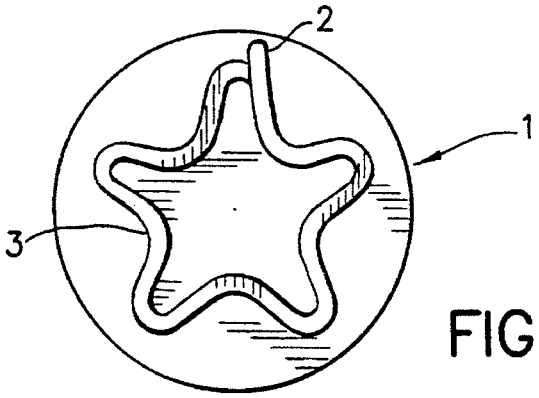

FIG. 8 shows a bottom view of the timepiece 1 with the flexible portion 3 in an irregular non-angular form.

Figure 9:
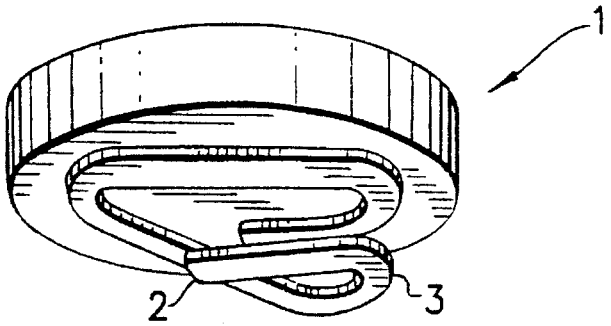
FIG. 9–11 are side views of timepieces with the attachment stretched out corresponding to FIGS. 6, 7 and 8.

FIG. 9 shows a side view of the timepiece 1 with the flexible portion 3 in an alternative shape, corresponding to FIG. 6, stretched out and in position to be attached to any edged item.

Figure 10:
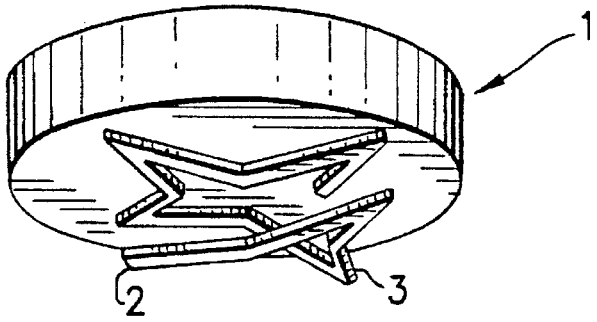

FIG. 10 shows a side view of the timepiece 1 with the flexible portion 3 in an alternative shape, corresponding to FIG. 7, stretched out and in position to be attached to any edged item.

Figure 11:
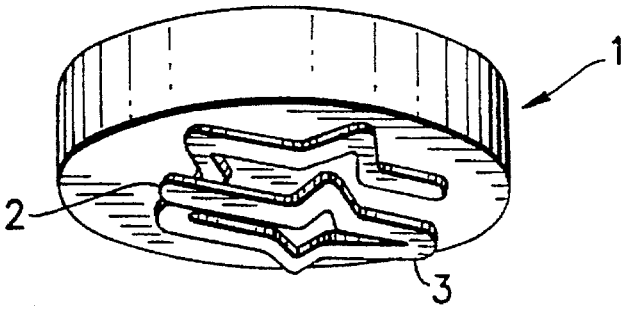

FIG. 11 shows a side view of the timepiece 1 with the flexible portion 3 in an alternative shape, corresponding to FIG. 8, stretched out and in position to be attached to any edged item.

Figure 12:
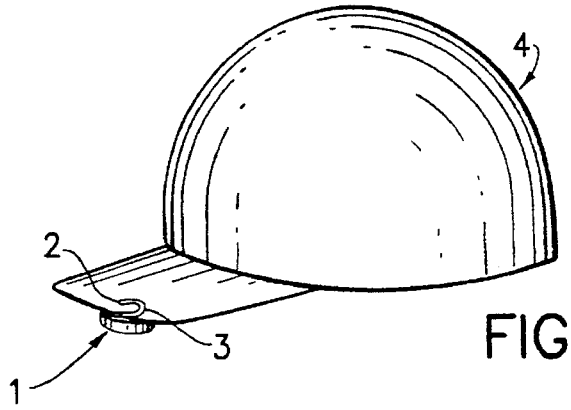
FIG. 12 shows a timepiece attached to the peak of a hat.

FIG. 12 shows a peaked hat 4 with the timepiece 1 attached by the coiled portion 3 of the device firmly attaching hat and attaching device.

Figure 13:
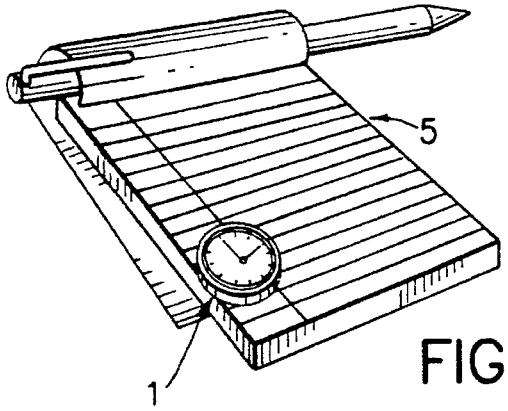
FIG. 13 shows a timepiece attached to a book.

FIG. 13 shows the timepiece 1 attached to the cover of a book 5.

Figure 14:
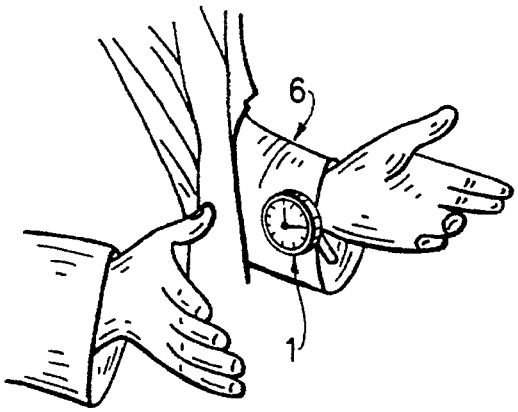
FIG. 14 shows a timepiece attached to a sleeve.

FIG. 14 shows the timepiece 1 attached to the sleeve 6 of a shirt or jacket.

Figure 15:
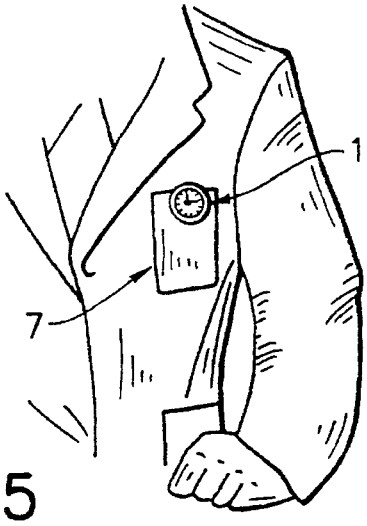
FIG. 15 shows a timepiece attached to a jacket pocket.

FIG. 15 shows the timepiece attached to the pocket 7 of a jacket or a shirt.

I claim:

1. A combined timepiece and device for attaching the timepiece to an edged item, consisting essentially of:

a timepiece including a housing having a generally thin configuration and a time displaying device mounted in said housing, said housing having a front surface through which said time displaying device can be viewed and an opposite substantially flat rear surface; and a spiral type attaching coil having one end fixed to said rear surface of said housing at a point of attachment thereon, with a remainder of said coil extending away from said one end in a spiral manner such that at least a portion of said remainder increasingly extends outwardly from said rear surface in accordance with movement along said spiral and such that said coil is substantially parallel with the substantially flat rear surface of said timepiece;

said attaching coil having at least one revolution (360 degrees) from said point of attachment to the housing, for attaching the timepiece to the edged item and for permitting placement of the timepiece at a desired rotational angle with respect to the edged item;

said attaching coil being made of a recoiling resilient material so that at least a portion of said attaching coil is self biased toward the timepiece and is resiliently bendable away from the timepiece to enable said attaching coil to be engaged over an edge of the edged item, and said attaching coil recoiling toward the timepiece to engage the timepiece firmly to the edged item with the edged item engaged against said recoiled bendable portion of said attaching coil and with the edged item gripped between the timepiece and the recoiled bendable portion of said attaching coil.

2. The combined timepiece and attaching device of claim 1, wherein said at least one revolution of said attaching coil is in the form of an ellipse.

3. The combined timepiece and attaching device of claim 1, wherein said at least one revolution of said attaching coil is in any regular shape.

4. The combined timepiece and attaching device of claim 1, wherein said at least one revolution of said attaching coil is in any irregular shape.

5. The combined timepiece and attaching device of claim 1, wherein a portion of said attaching coil is initially bent away from the timepiece by a predetermined distance to permit easy entry of the edged item.

* * * * *